US008628428B2

(12) United States Patent
Vaioli

(10) Patent No.: US 8,628,428 B2
(45) Date of Patent: Jan. 14, 2014

(54) METHOD AND A SYSTEM FOR MANAGING AT LEAST ONE EVENT IN A BOWLING ESTABLISHMENT

(75) Inventor: Roberto Vaioli, Ozzano Dell'Emilia (IT)

(73) Assignee: QubicaAMF Europe S.p.A., Bologna (IT)

( * ) Notice: Subject to any disclaimer, the term of this patent is extended or adjusted under 35 U.S.C. 154(b) by 3106 days.

(21) Appl. No.: 10/868,943

(22) Filed: Jun. 17, 2004

(65) Prior Publication Data

US 2005/0089153 A1 Apr. 28, 2005

(30) Foreign Application Priority Data

Jun. 17, 2003 (IT) ..... BO2003A0368

(51) Int. Cl.
*A63F 9/24* (2006.01)

(52) U.S. Cl.
USPC ..... 473/67; 463/20; 463/16; 273/143 R

(58) Field of Classification Search
USPC ..... 340/323 B; 364/410–411; 700/92; 358/93, 108; 434/249; 473/71
See application file for complete search history.

(56) References Cited

U.S. PATENT DOCUMENTS

| | | | | |
|---|---|---|---|---|
| 2,781,898 | A | 9/1956 | Goldstein | |
| 2,937,370 | A * | 5/1960 | Dugan | 340/313 |
| 3,470,553 | A * | 9/1969 | Hyde | 340/526 |
| 3,659,279 | A * | 4/1972 | Wise | 19/145.5 |
| 4,570,217 | A * | 2/1986 | Allen et al. | 700/83 |
| 4,592,548 | A * | 6/1986 | Oldson | 473/66 |
| 4,660,833 | A * | 4/1987 | Dickinson et al. | 463/20 |
| 5,001,554 | A * | 3/1991 | Johnson et al. | 725/8 |
| 5,101,354 | A * | 3/1992 | Mowers et al. | 700/92 |
| 5,195,130 | A * | 3/1993 | Weiss et al. | 379/93.19 |
| 5,198,976 | A * | 3/1993 | Form et al. | 700/91 |
| 5,210,704 | A * | 5/1993 | Husseiny | 702/34 |
| 5,233,654 | A * | 8/1993 | Harvey et al. | 725/135 |
| 5,241,379 | A | 8/1993 | Tsujita | |
| 5,313,468 | A * | 5/1994 | Hoshi et al. | 714/36 |
| 5,666,481 | A * | 9/1997 | Lewis | 714/4 |
| 5,683,080 | A * | 11/1997 | Vaioli et al. | 473/69 |
| 5,696,486 | A * | 12/1997 | Poliquin et al. | 340/506 |
| 5,740,357 | A * | 4/1998 | Gardiner et al. | 714/57 |
| 5,917,405 | A * | 6/1999 | Joao | 340/426.17 |
| 5,931,878 | A * | 8/1999 | Chapin, Jr. | 701/30 |
| 5,971,851 | A * | 10/1999 | Pascal et al. | 463/24 |
| 6,032,184 | A * | 2/2000 | Cogger et al. | 709/223 |
| 6,256,594 | B1 * | 7/2001 | Yamamoto et al. | 702/185 |

(Continued)

FOREIGN PATENT DOCUMENTS

| | | |
|---|---|---|
| EP | 0 338 768 | 10/1989 |
| JP | 2001-344507 | 12/2001 |
| JP | 2002-215982 | 8/2002 |

*Primary Examiner* — Paul A D'Agostino
(74) *Attorney, Agent, or Firm* — Andrew M. Calderon; Roberts Mlotkowski Safran & Cole, P.C.

(57) ABSTRACT

Described is a system for managing at least one event in a bowling establishment or similar facility (10). The bowling establishment includes at least one lane (12) along which a bowl (13) is rolled and an apparatus (16) for setting up the pins (P) and returning the bowl (13). The system further includes elements for generating a signal relating to an event, the event advantageously producing a condition calling for service to be carried out on the pin setting up apparatus.

97 Claims, 5 Drawing Sheets

(56) References Cited

U.S. PATENT DOCUMENTS

| | | | | |
|---|---|---|---|---|
| 6,324,659 | B1 * | 11/2001 | Pierro | 714/48 |
| 6,338,152 | B1 * | 1/2002 | Fera et al. | 714/48 |
| 6,353,726 | B1 * | 3/2002 | Murata et al. | 399/407 |
| 6,493,598 | B1 * | 12/2002 | Shea | 700/92 |
| 6,539,499 | B1 * | 3/2003 | Stedman et al. | 714/40 |
| 6,587,046 | B2 * | 7/2003 | Joao | 340/539.14 |
| 6,623,369 | B1 * | 9/2003 | Shea | 473/57 |
| 6,718,513 | B1 * | 4/2004 | Ryu | 714/799 |
| 7,237,138 | B2 * | 6/2007 | Greenwald et al. | 714/4 |
| 2002/0058550 | A1 * | 5/2002 | Pace et al. | 463/42 |
| 2002/0147514 | A1 | 10/2002 | Apple et al. | |
| 2002/0174207 | A1 * | 11/2002 | Battou | 709/223 |
| 2003/0060311 | A1 | 3/2003 | Mockry et al. | |
| 2004/0088141 | A1 * | 5/2004 | Ashley | 702/184 |
| 2004/0088601 | A1 * | 5/2004 | Shah et al. | 714/15 |
| 2005/0183130 | A1 * | 8/2005 | Sadja et al. | 725/107 |

* cited by examiner

FIG. 7

Hillside lanes

Machine Down Time Report

| Date (303) | Lane Number (304) | Game Type (306) | Error Source (308) | Error Start Time (310) | Mechanic's Arrival Time (312) | Mechanic's Response Delay Time (314) | Work Complete Time (316) | Total Down Time (318) | Total Work Time (320) | Mechanic (322) | Comments (324) |
|---|---|---|---|---|---|---|---|---|---|---|---|
| | | | | | | | | | | | |
| March 17th, | 12 | Open | Machine | 9.15.00 | 9.22.10 | 0.07.10 | 9.22.15 | 0.07.15 | 0.07.15 | John | |
| March 17th, | 23 | League | Mechanic | 9.55.00 | 9.55.00 | - | 9.55.50 | 0.00.50 | 0.00.50 | Steve | |
| March 17th, | 1 | League | F-Desk | 10.52.05 | 10.53.15 | 0.01.10 | 10.54.00 | 0.01.55 | 0.01.55 | Steve | |
| March 17th, | 1 | Open | Machine | 10.53.05 | 10.54.20 | 0.01.15 | 12.35.50 | 0.01.55 | 0.01.55 | John | Closed at 11.20.12 |
| March 17th, | 3 | Open | Machanic | 10.54.47 | 10.54.55 | 0.01.12 | 10.54.55 | | | John | Cancelled from Mech |
| March 17th, | 7 | Open | F-Desk | 10.55.00 | 10.57.15 | 0.02.15 | 11.01.00 | 0.06.00 | 0.06.00 | | |
| March 17th, | 24 | Open | Player | 13.02.10 | 13.03.15 | 0.01.05 | 13.05.15 | 0.03.05 | 0.03.05 | Carl | |
| March 17th, | 8 | Open | Player | 13.29.15 | 13.29.30 | 0.00.15 | 13.29.35 | 0.00.45 | 0.00.45 | Carl | Cancelled from Phone |
| March 17th, | 15 | Open | Machine | 17.05.10 | 17.06.15 | 0.01.05 | 17.07.15 | 0.02.05 | 0.02.05 | | |
| March 17th, | 10 | League | Machine | 19.55.12 | 19.58.01 | 0.02.49 | 20.01.10 | 0.05.58 | 0.05.58 | | |
| March 17th, | 9 | Open | Player | 19.58.00 | 19.58.20 | 0.00.20 | 20.10.03 | 12.03.00 | 12.03.00 | | Transfer at 20.10.08 |
| March 17th, | 1 | League | Player | 23.24.00 | 23.24.45 | 0.00.45 | 23.25.00 | 0.01.00 | 0.01.00 | | |
| | | | | | | | | | | | |
| Totals For Period | | | 9 | | | | | 12.33.48 | 12.33.48 | | |

300

| REPORT SUMMARY VIEW | |
|---|---|
| TOTAL FRAMES | 768 |
| TOTAL STOPS | 12 |
| FRAMES PER STOP AVE | 672 |

326 328 330 301

| | |
|---|---|
| Average responde time | 0.01.46 |
| Average work time | 0.01.46 |

332 303 334

METHOD AND A SYSTEM FOR MANAGING AT LEAST ONE EVENT IN A BOWLING ESTABLISHMENT

BACKGROUND OF THE INVENTION

The present invention relates to a method for managing at least one event in a bowling establishment or similar facility.

According to prior art, bowling establishments comprise a plurality of lanes, each including a bowlers' bay equipped with suitable control means, in the form of a control panel or console, which can be operated by the players. Each bowling lane is also equipped with apparatus for setting up the pins at the end of the lane and returning the bowl to the players.

In prior art, this apparatus consists of a machine for setting up the pins and comprises means for detecting events or faults such as, for example, a jammed pin or bowl. In machines used up to now for setting up the pins, however, the faults detected are simply displayed by plain fault indicators consisting, for example, of a lamp or LED.

These meagre fault indicating means used in prior art apparatus make it practically impossible to know the true efficiency of fault servicing operations and the reliability of the pin setting up machines being used.

Moreover, when a fault occurs in a bowling establishment of the type known up to now, the players are not informed of the actual state of events. As a result, the players may lose their patience or overreact to certain situations and may, for example, go to the manager to ask to be transferred to another lane, whilst in actual fact the fault is being rapidly rectified at that very moment. Another possibility is that the players do not realise that a bowl has got jammed and continue to throw other bowls at the area where the jam has occurred, thus creating a build-up of jammed bowls, worsening the situation and possibly also causing damage to the bowling establishment equipment. This leads to a considerable waste of time and economic loss for the management of the bowling centre.

Furthermore, in the event of a jam in the pin setting up machine, resulting for example in failure to set up the correct number of pins, there is currently no way of quickly reporting the fault to have it promptly rectified, leading to further time being wasted and more economic loss for the management of the bowling centre.

In practice, the prevailing feeling is that problems caused by machine faults or errors in current bowling centres are badly managed, which translates as considerable economic loss for the bowling centre since customers pay on the basis of the time they actually play.

SUMMARY OF THE INVENTION

To overcome the above mentioned drawbacks, the present invention provides a method for managing at least one event in a bowling establishment or similar facility, the bowling establishment comprising at least one lane along which a bowl is rolled and an apparatus for setting up the pins and returning the bowl; the method comprising a step of generating a signal relating to the event and being characterised in that the event produces a call for service condition.

In this way, it is possible at least to obtain information regarding the efficiency of service staff employed by the bowling centre.

The present invention also relates to a system for managing at least one event in a bowling establishment or similar facility.

The invention further relates to a computer medium in which the program implementing the operating procedures of the system according to the invention are stored.

Other advantageous aspects of the method and system according to the present invention are set out in the other claims.

BRIEF DESCRIPTION OF THE DRAWINGS

The technical characteristics of the invention are clearly described in the claims below and its advantages are apparent from the detailed description which follows, with reference to the accompanying drawings which illustrate preferred embodiments of the invention provided merely by way of example without restricting the scope of the inventive concept, and in which:

FIG. 7 illustrates a set of tables generated by the system according to the invention and containing statistical data relating to a bowling establishment equipped with the system according to the invention.

DESCRIPTION OF THE PREFERRED EMBODIMENT

A preferred embodiment of the system according to the invention for managing at least one event in a bowling establishment is illustrated in the accompanying drawings.

Figure 2:
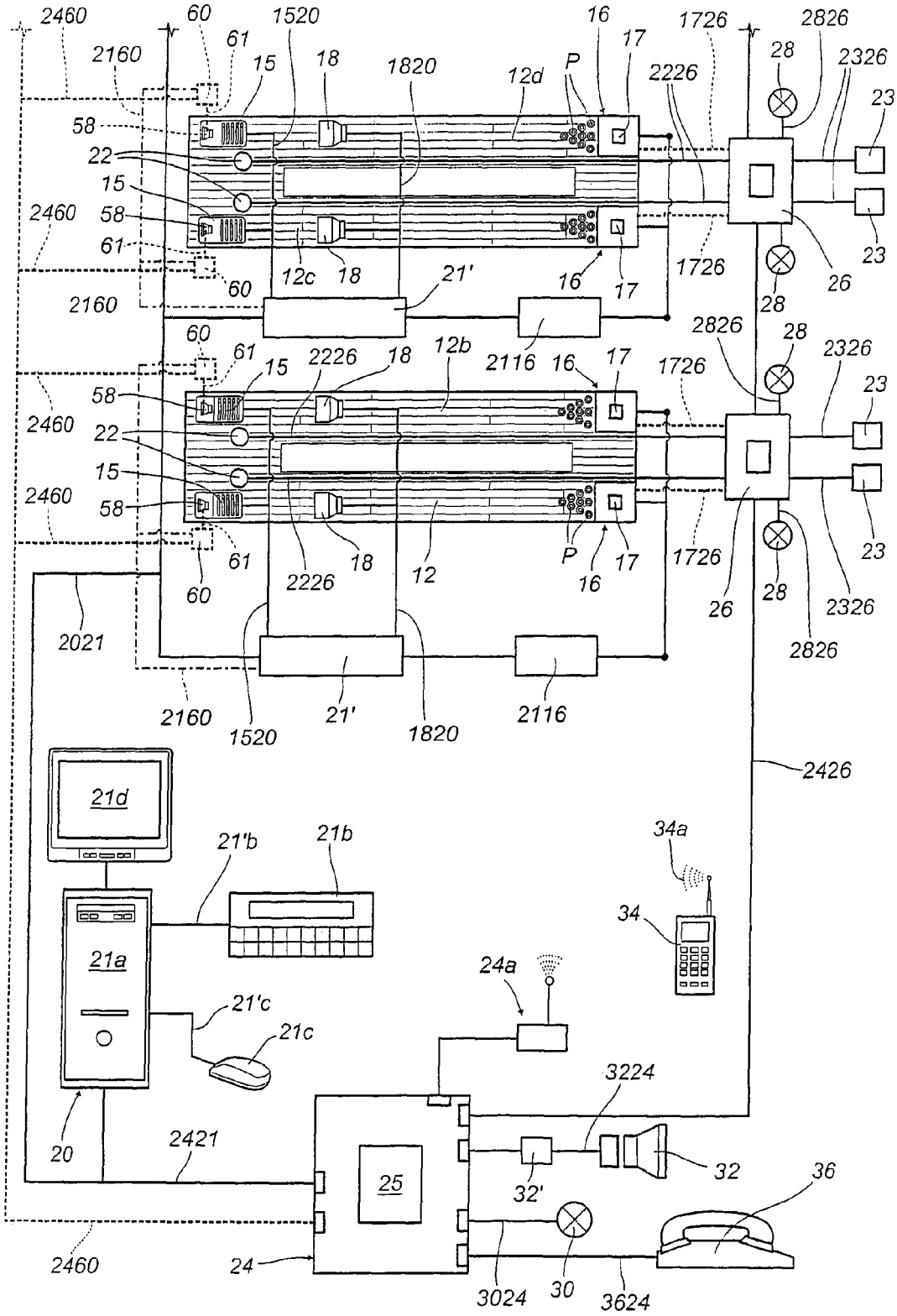
FIG. 2 is a block diagram of a preferred embodiment of the event management system according to the invention.

The bowling establishment 10 comprises a plurality of bowling lanes. More specifically, it comprises a plurality of lanes arranged in pairs of lanes placed side by side. FIG. 2 illustrates only a first and a second pair of lanes 12, 12*b* and 12*c*, 12*d*, respectively. It should be understood, however, that the alley may comprise a much higher number of lanes than is illustrated in the accompanying drawings.

Figure 1:
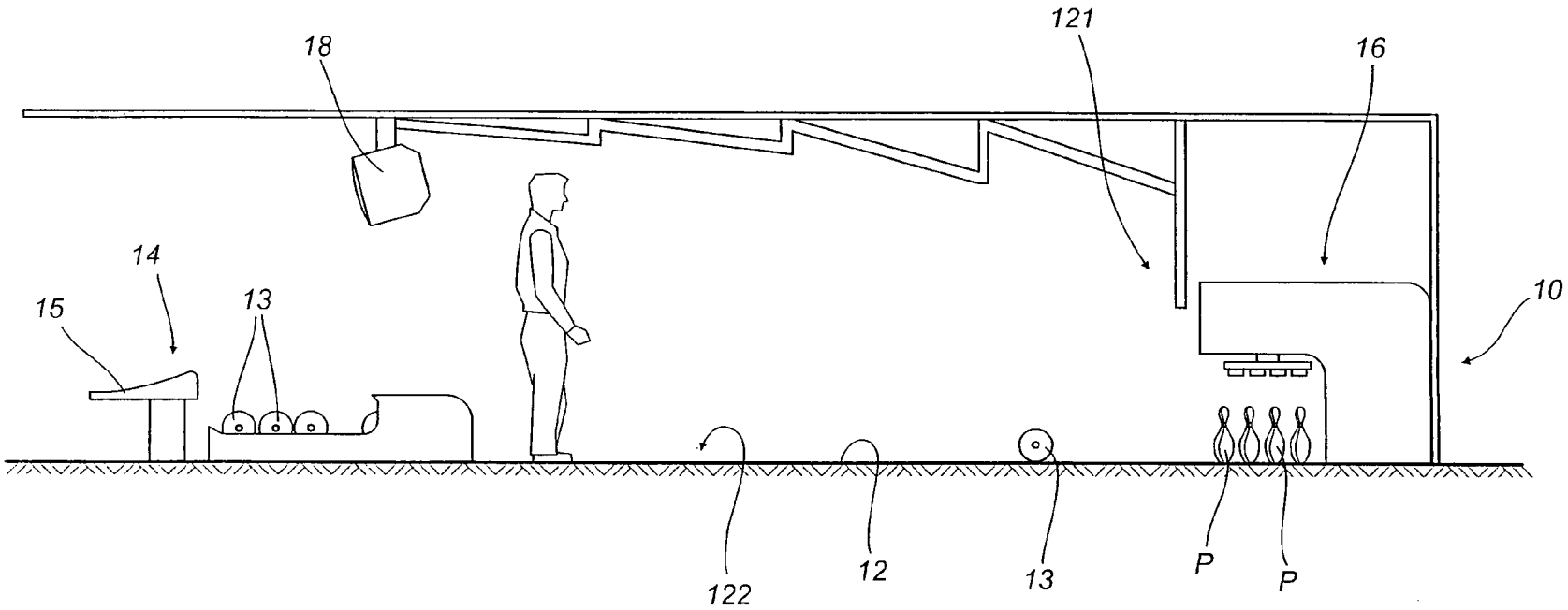
FIG. 1 is a schematic side view of a bowling lane equipped with the system according to the invention.

As shown in particular in FIG. 1, the lane 12, like the other lanes, has at one end of it an area or pit 121 where the pins "P" to be knocked down are placed and, at the other end, an area 122 from where the bowler rolls the bowl 13.

The bowling establishment further comprises a bowlers' bay 14 located close to the end area 122 from where the bowl is rolled. The bowlers' bay is equipped with control means 15 to be operated by the bowlers and consisting of a control console 15. At the bowlers' bay there are also display means. The display means consist of a monitor or screen 18 mounted over the bowlers' bay in a raised position where it can be easily seen by the players. Under normal operating conditions, the screen 18 displays animations and scores connected with the game in progress.

An apparatus 16 is also provided for setting up the pins P and returning the bowl 13, the apparatus being located at pit where the pins P are placed. The pin P setting up apparatus 16 comprises means 17 for detecting an event, the event being in the form of a fault in the machine 16. The fault may consist, for example, of a jammed pin or bowl in the machine. Apparatuses for setting up the pins and returning the bowl to the players and equipped with means for detecting faults of the above mentioned type and providing an indication of the fault by switching on a light are well known to experts in the trade and, for brevity, will not be described in further detail.

Prior art pin setting up machines also include fault indication means in the form of a lamp that switches on in the presence of a fault.

The system also includes main control means 20, operated by the bowling establishment management from a main station, known as FRONT DESK, for controlling all the bowling lanes. The management's control means comprise main processing means consisting, more specifically, according to this preferred embodiment, of a personal computer (PC) denoted generically by the number reference 21*a*, which runs a program that controls the machinery of the entire bowling establishment. The processing or control means 20 have suitable input means such as a keyboard 21*b* and a mouse 21*c*.

At the FRONT DESK there are also suitable display means, in the form of a screen 21*d*, which, under normal conditions, shows the operating state of the lanes.

The processing or control means present a respective program for suitably controlling the images displayed by the screen 18 and relating to normal playing conditions.

The system according to the invention advantageously comprises means for generating a signal relating to the event. More specifically, the event might consist of a fault or error in the pin setting up apparatus or a lane fault which cannot be detected by the pin setting up apparatus, such as, for example, a missing pin.

The signal might also be a notification signal transmitted automatically to the operator or mechanic when a fault is detected.

This makes it possible to take prompt action, without wasting time, to eliminate the fault or error wherever it occurs.

The notification might be given, for example, by means of a telephone call (transmitting a predetermined message), a siren and/or a predetermined message transmitted over the loudspeaker. In the cases of the telephone call and loudspeaker, the message transmitted may be a pre-recorded message or an automatically generated message. The signal might also be a notification addressed to the players, as described in more detail below.

The event may also consist of the cancellation or resetting of the error or fault.

The resetting event is generated after the fault indication event. The resetting event might, for example, be generated when it is noticed that the fault signal has been issued by mistake and that no fault has in fact occurred. This avoids unnecessary action being taken in a situation where the error signal is issued by mistake.

The event might also consist of a signal acknowledging receipt of the call or notification by the operator or mechanic. This type of event produces a condition calling for service to be carried out on the apparatus for setting up the pins and returning the bowl.

The event may also consist of a signal indicating that work to remedy the fault has commenced. The event signal indicating commencement of work is generated after the fault indication event, when the operator reaches the area where the fault has occurred and begins working on the solution to the problem. This helps to provide information on how long it will take to remedy the fault.

The event may also consist of a signal indicating that work on the fault has been completed. This makes it possible to resume playing promptly, thus significantly reducing down time for the bowling centre. Further, the length of time actually taken to remedy the fault can be measured accurately.

The work completed event is generated after the work in progress event when the operator has finished working on the fault.

In this way, it is possible to obtain statistical data providing information on the efficiency of staff employed and, indirectly, also on the reliability of the machinery and equipment used. As explained in more detail below, these events may be displayed on screen, thus informing the persons involved, saving much time and avoiding unpleasant misunderstandings.

According to another aspect of the invention, the event might also consist of a decision to close the lane affected by the fault where work is in progress or to transfer the players to another lane.

In particular and advantageously, the activation signal may be such as to identify the source that issued the signal.

Preferably, the activation signal is also such as to permit identification of the type of event or type of fault detected.

Further, the activation signal is such as to also permit identification of the area where the event has occurred, and, more specifically, the part of the pin setting up machine where the fault has occurred. More specifically, the signal may be such as to indicate whether the part of the machine requiring service is the front or the back of the machine. This saves a considerable amount of time because it allows the operator to go directly to the part of the machine that requires service.

Preferably and advantageously, the signal generating means are means that can be activated manually, making it possible to report faults that cannot be reported otherwise.

More specifically, the signal generating means comprise a control console or keyboard.

Thus, the console for generating the event signal advantageously consists of the console 21*b* located at the main control station 20, that is to say, at the FRONT DESK controlling the bowling establishment and constitutes first signal generating means.

According to another advantageous aspect, second signal generating means are also provided, these consisting of the second console 15 located at the bowlers' bay.

The signal generating means may also be means that automatically generate the event signal. For this purpose, the signal generating means consist of means 17 for controlling the pin setting up apparatus and constituting third means for generating a fault signal (consisting, for example, of an automatic switch or microswitch mounted in the apparatus).

Thus, according to yet another advantageous aspect, these signal generating means are switch-activated means.

More specifically, these signal generating means consist of a switch 23 that can be operated by a respective pushbutton located on the pin setting up apparatus. This makes it possible to know with certainty when work on the fault has started. Indeed, this switch can be activated only when the pushbutton on the pin setting up apparatus is pressed.

This switch on the pin setting up apparatus preferably has two different working conditions. In practice, the pushbutton can be pressed and released quickly or it may be pressed and held down to indicate different events, as explained in more detail below.

According to another aspect, the signal generating means are also means equipped with a switch 22 that can be operated by a respective pushbutton and located at the bowlers' bay and, more specifically, on the bowl stand 13'.

In the embodiment illustrated, there is a pushbutton or switch 22 for each lane. There might, however, also be a single pushbutton or switch 22 for each pair of adjacent lanes.

According to yet another aspect, the signal generating means also consist of a phone set. More specifically, it is a portable telephone 34 enabling the operator—in particular, the maintenance and repair technician—to move about freely and to send signals from any position. Another phone set is constituted by a fixed telephone 36 installed in an office used by the mechanics or operators, which may be at some distance from the FRONT DESK, or even outside the bowling area.

The system according to the invention also comprises control means that generate a signal for encoding a signal to be emitted in response to the event signal.

This response signal constitutes at least one item of information or an action relating to the event. More specifically, the control means comprise a main control unit constituted by the main control unit 21*a* driven by a main program that manages all the events of the bowling establishment.

As illustrated in FIG. 2, the screens 18 and consoles 15 of the bowlers' bays are connected to the main processing unit 21*a* by a respective unit 21' for controlling respective lanes, in particular respective pairs of lanes, through suitable cables 1820 and 1520.

The lane control unit 21' is also connected to the pin setting up apparatus 16 by a respective interface unit 2116.

The interface units 2116 and the lane control unit 21' are connected to the main computer 21*a* through an ethernet network which has connecting cables 2021 and which also connects the central control unit 24, described in more detail below.

The main processing unit 21*a* also has the mouse 21*c* and the keyboard 21*d* of the FRONT DESK connected to it through connections 21'*c* and 21'*d* or equivalent means.

The system control means also comprise a central event control unit 24, known as HOST, that communicates with the main processing unit 21*a*, in particular through a network connection 2421.

The central control unit 24 comprises processing means consisting of a CPU 25 or similar unit, and suitable input-output means.

The system control means also comprise a local control unit 26 that communicates with the central control unit 24 through data transmission cables 2426. The switch 23 at the pin setting up machine 16 communicates with the local control unit 26 through transmission cables 2326.

In another preferred embodiment, the automatic switch 17 or equivalent means for indicating events that have occurred within the respective pin setting up machine 16 communicates with the respective local control unit 26 through a respective connection 1826, shown by a dashed line in FIG. 2. In this case, there is no need to pass through the lane control units, which could therefore be omitted, thus using less components to obtain a simplified structure but without thereby reducing event management efficiency.

The switch 22 at the bowlers' bay 14 also communicates with the local control unit 26 through transmission cables 2226.

Means are also provide for emitting a signal in response to the event.

More specifically, this signal may be a luminous signal, for example a flashing light.

For this purpose, the means for emitting this signal comprise a lamp or LED 28 located at the lane 12 and connected to the local control means 26 through a respective connection 2826.

A second lamp or LED 30 is located in the office of the maintenance technician or mechanic and is connected to the central control means 24 through a connection 3024.

This signal may be an audible signal emitted by a loudspeaker 32 connected to the central control means 24 through a respective amplification unit 32' by a connection 3224.

According to another aspect, this signal may be a video signal emitted by the screen 18 located at the lanes.

According to yet another aspect, this signal may be emitted in the form of a phone signal.

The means for emitting this signal, therefore, comprise the portable telephone 34 carried by the mechanic. The portable telephone 34 has an aerial 34*a* that communicates with an aerial of a transmission unit 24*a* which is connected to the central unit 24. In this particular instance, it is a cordless telephone whose base unit 24*a* is connected to the central unit 24 instead of being connected to an external telephone line.

The phone set may also consist of a telephone 36 connected by a cable 3624 to the central unit 24 and installed in the office of the maintenance and repair technicians or mechanics. Another similar telephone in this embodiment of the system might also be provided at the FRONT DESK. This FRONT DESK telephone is not illustrated in the accompanying drawings.

The response signal comprises at least one item of information relating to the event. The item of information relating to the event defines a notification of a fault.

More specifically, the fault notification may define the type of fault.

The fault notification may also be such as to identify the area in which the fault has occurred, and more specifically, whether the part of the pin setting up apparatus 16 affected by the fault and requiring service is accessible from the front or from the back of the apparatus.

In addition to indicating the presence of the fault, the message may at the same time also indicate that the mechanic has been called.

According to another aspect, the message may also indicate that service operations are in progress, that is to say, that the mechanic has arrived and is working on the apparatus.

This may be followed by a message indicating that service operations have been completed.

Yet another message may indicate that the lane has been closed and that players should transfer to another bowling lane.

In short, a preferred embodiment of the system according to the invention is driven by a control program providing suitable means or instructions that operate as described below. More specifically, the description that follows refers to a flow chart in which each block is an operation or event implemented by, or which cause other operations or events to be implemented by, suitable means or instructions forming part of the program.

Figure 3:
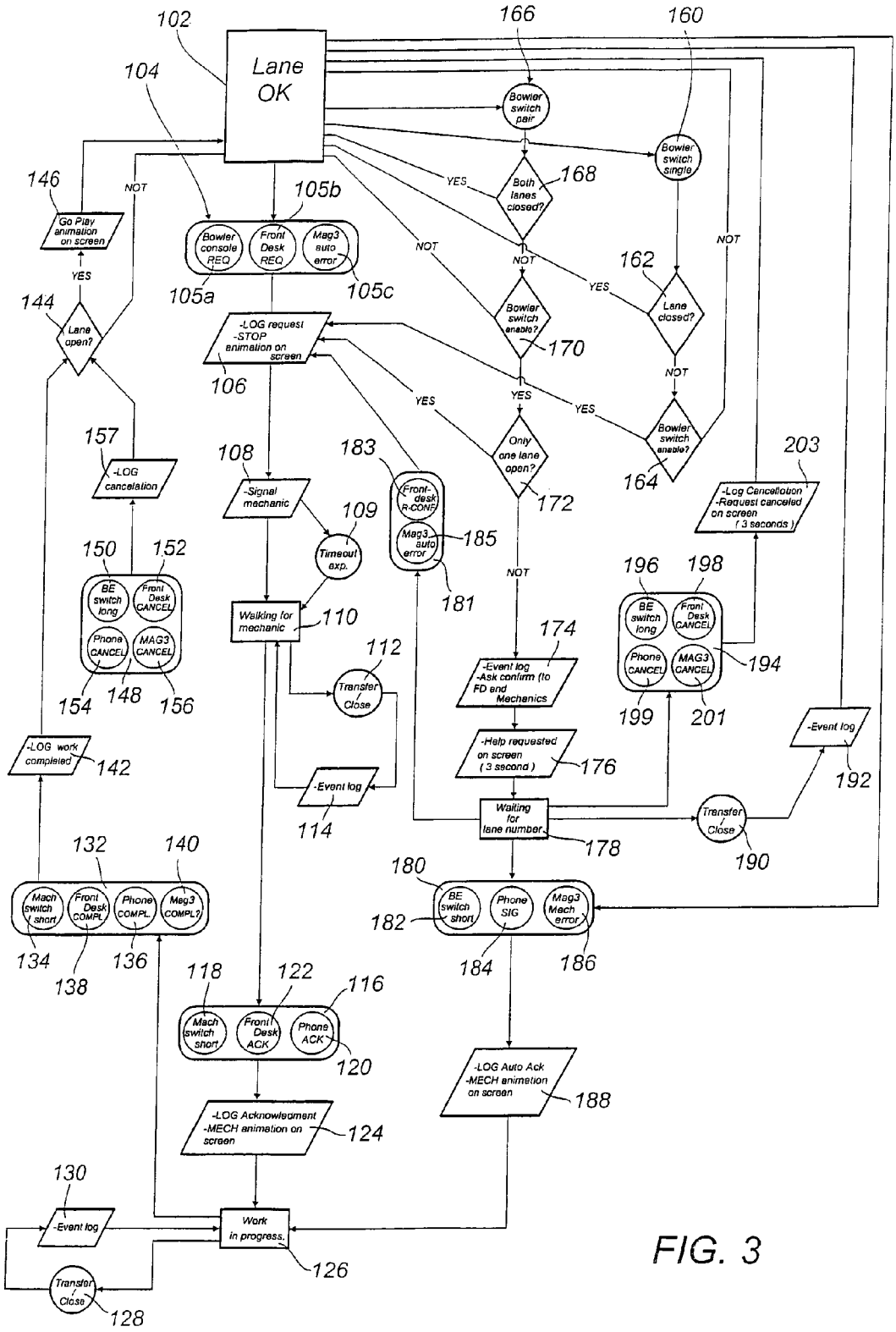
FIG. 3 is a flow chart illustrating the procedures implemented by suitably programmed instructions or means in a preferred operating mode of the system according to the invention.

Thus, as illustrated in the chart of FIG. 3, starting from a condition in which a bowling lane is in a normal working condition termed OK in the block 102, a fault signal may be generated, as shown in the block 104.

This signal may be generated manually using the console 15 at the bowler's bay, as shown by the block 105*a* within the block 104 in the chart of FIG. 3, or the console 21*b* at the front desk, as shown by the block 105*b* within the block 104 in the chart of FIG. 3, or automatically by the pin setting up machine 16, as shown by the block 105*c* within the block 104 in the chart of FIG. 3. In other terms, the fault may be reported by a player or by the manager or detected automatically by the pin setting up machine 16.

Once generated, the signal is sent by the console 15 at the bowlers' bay and by the console 21*b* at the front desk, to the main processing means 21*a*, and by the pin setting up machine 16 to the central control means 24.

Figure 4:
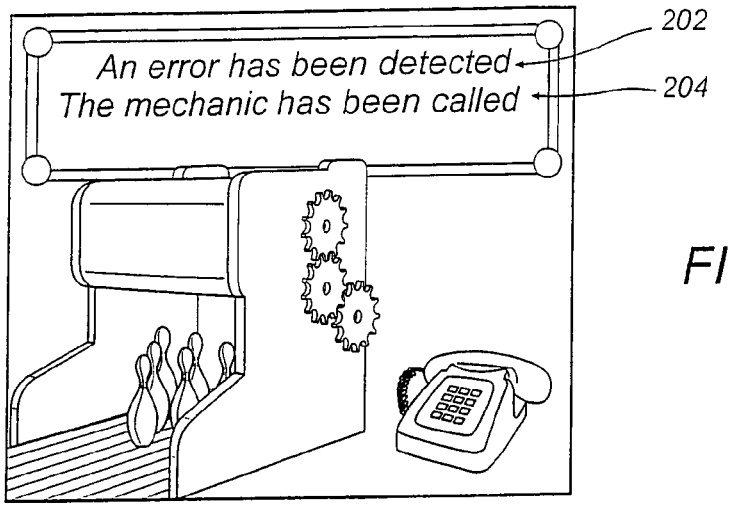
FIGS. 4 to 6 schematically illustrate on-screen information displayed by the system according to the invention.

After receiving the fault or error signal, the program in the main server 21*a* produces an event which causes an image to be displayed to indicate the presence of a fault, as illustrated in FIG. 4. As shown in the block 106, the screen 18 at the bowlers' bay now displays a fixed or animated image, as illustrated in FIG. 4, which includes at least one part 202 which informs the players that a fault has been detected and at least one part 204 which informs the players that the mechanic has been called.

This starts an automatic program routine which, as shown in the block 108, sends out a call to the mechanic or maintenance technician through the portable telephone 34 or the fixed telephone 36, or by a message over the loudspeaker 32 or by switching on a luminous signal through the light emitting means 30.

As shown by the block 109, the system now starts counting the time taken by the mechanic to reach the machine or respond to the call. As indicated by the block 110, the system is set to standby, waiting to receive the mechanic's response. Under these conditions, the management at the front desk 20 has the option, as shown by the block 112, of closing down the lane and, if necessary, transferring the players to another lane. This event is processed as shown by the next block 114.

At this point, the next event is the acknowledgement of receipt of call, as shown by the block 116.

This acknowledgement may indicate either that the mechanic has reached the machine or only that the call has been received.

In practice, after reaching the machine, the mechanic indicates his presence by pressing and immediately releasing the pushbutton on the device 23 at the machine, as shown by the block 118 within the block 116.

Alternatively, the mechanic may simply acknowledge receipt of the call using the portable telephone 32 or other device, as shown by the block 120 within the block 116. The acknowledgement of the call may be effected by pressing a set of keys on the telephone keypad in a predetermined sequence or in any other suitable manner such as, for example, by a vocal response recognisable by the system.

It may also be imagined that, while rectifying the fault, which must be done as quickly as possible, the mechanic might also produce a work report (for example, short notes or a spoken message) using the portable telephone. The report could be saved in an appropriate memory area of the management system control unit and called up and viewed or heard at a later stage as a reminder to facilitate the tracing of problems which were noticed during the service call but which could not be dealt with immediately due to shortage of time.

According to another procedure, acknowledgement of receipt of the fault signal can be given by the management at the front desk using the main console 21*b*, as shown by the block 122 within the block 116.

The acknowledgement signal is processed as shown by block 124 and the lane placed in a state of "work in progress", as shown by the next block 126.

Figure 5:
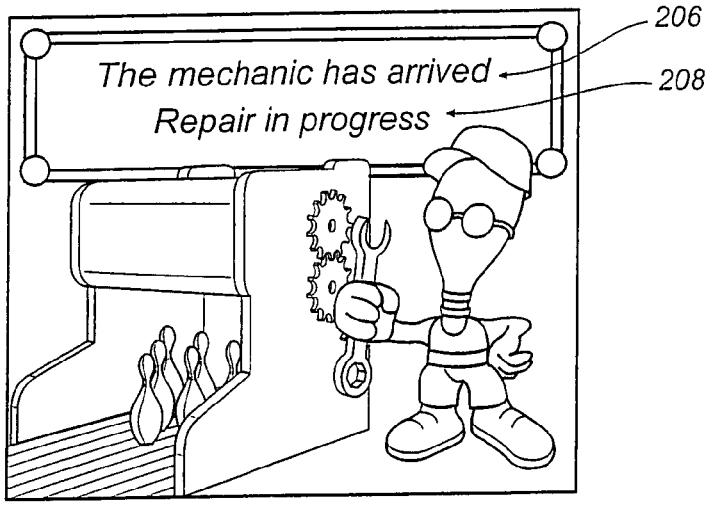

In this situation, as shown by the block 124, the screen 18 at the bowlers' bay now displays a fixed or animated image, as illustrated in FIG. 5, which includes at least one part 206 which informs the players that the mechanic has arrived and at least one part 208 which informs the players that repairs are progress. Under these conditions, the management at the front desk 20 has the option, as shown by block 128, of closing down the lane and, if necessary, transferring the players to another lane. This event is processed as shown by the next block 130.

Once the repairs have been completed and the fault has been set right, a message is displayed to inform the players, as shown by the block 132.

The repair work completed signal can be given by the mechanic pressing the pushbutton switch 23 on the pin setting up machine 16, as shown by the block 134 within the block 132.

In this case, the pushbutton is pressed and released immediately.

The repair work completed signal might also be given, again by the mechanic, using the telephone, as shown by the block 136 within the block 132.

In yet another case, the repair work completed signal might also be given through the main console 21*b*, that is to say, automatically by the pin setting up machine 16, as shown by the blocks 138 and 140 within the block 132.

At this point, the repair work completed signal is processed as shown by the next block 142.

Figure 6:
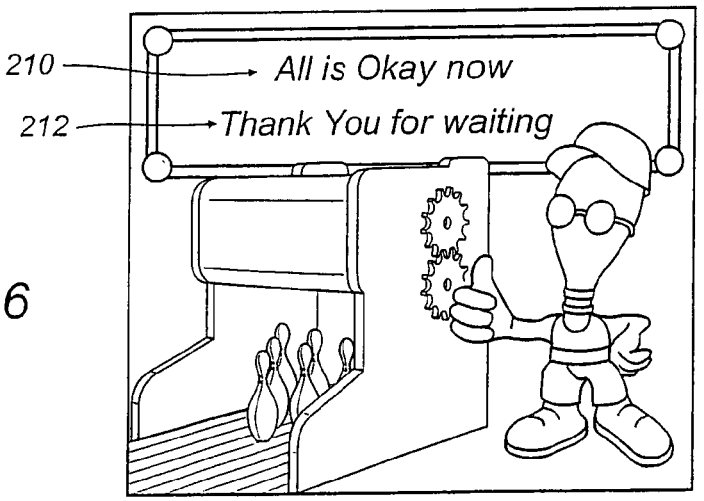

As shown by the block 142, the screen 18 at the bowlers' bay now displays a fixed or animated image which, as illustrated in FIG. 6, includes at least one part 210 which informs the players that repairs have been completed and at least one part 212 which might provide other information or, as in the case illustrated, thanks the players for waiting.

In addition, the repairs completed signal is processed by a routine 144 which checks whether the lane concerned should be considered open or closed. If the lane is considered open, the system or main control unit resumes the match from the point where it was interrupted, as shown by the block 146.

The block 148 indicates an action of cancelling the fault signal when the latter is given by mistake. The cancellation signal can be given using the pushbutton switch 23 (which in this case must be pressed and held down for some time), by a respective command from the console 21*b* at the front desk, by a phone call or by a signal generated automatically by the pin setting up machine, as shown, respectively, by the blocks 150, 152, 154 and 156 within the block 148. The cancellation signal then enters the block 144 to check whether the lane concerned is active or not.

The cancellation signal is processed, as shown by the block 157 and, if the lane is open, the system resumes operation by activating the procedure of the block 144 and following.

As shown by the side branch of the flow chart of FIG. 3, the error or fault signal might also be generated by a pushbutton switch 22 located at the bowler's bay and, more specifically, on the bowl stand, as shown by the block 160.

This event signal is first tested to check whether the lane is actually open, as shown by the block 162. If the test result is affirmative and the lane is considered open, the signal is tested again, as shown by the block 164, to check whether the pushbutton 22 is enabled. If the response is affirmative, that is to say, if the pushbutton is enabled, then the procedure is resumed from the block 106 and proceeds as described above.

In some bowling establishments, a single pushbutton 22 serves two separate adjacent lanes.

In this case, it is advisable to start from the block 166, which indicates a signal given by the pushbutton 22 serving two different lanes.

In this case, the signal is first tested, as shown in the block 168, to check whether both lanes are closed or open.

If the lanes are open, the system proceeds to the next block 170 which checks whether the pushbutton 22 is enabled or not.

If the pushbutton 22 is enabled, the system checks, in the block 172, whether only one of the lanes is open.

If only one lane is open, the procedure starts from the above mentioned block 106 and proceeds as described above.

If both lanes are open, then the signal is processed and, as shown by the block 174, the system sends out a request to the front desk, through the screen 21*d*, and, if necessary to the mechanic, asking for confirmation as to which lane is affected by the fault event, as shown by the block 176.

The system then waits to receive the number of the lane concerned, as shown by the block 178, which may be indicated, as shown by the next block 180, by pressing and immediately releasing the pushbutton 23 at the pin setting up machine, by a telephone call, or by a fault event detected by the pin setting up machine of the lane concerned, as shown, respectively, by the blocks 182, 184 and 186 within the block 180.

This starts the procedure of acknowledgement and displaying a fixed or animated image on the screen 18 at the bowlers' bay, as shown by the block 188, this procedure being identical to the one represented by the block 124 of the main procedure. From this point on, the system proceeds in the manner described above.

Proceeding in a different manner, with the system waiting to receive the number of the lane concerned, as shown by the block 178, the lane may also be indicated, as shown by the next block 181, manually using the console at the FRONT DESK or automatically by the pin setting up machine, as shown, respectively, by the blocks 183 and 185 within the block 181.

This starts the procedure represented by the block 106 whereby the screen 18 at the bowlers' bay displays a fixed or animated image, as illustrated in FIG. 4, which includes at least one part 202 which informs the players that a fault has been detected and at least one part 204 which informs the players that the mechanic has been called.

From the block 106 on, the system proceeds in the manner described above.

Under these conditions, with the system waiting to receive the number of the lane concerned, the management at the front desk 20 has the option, as shown by block 190, of closing down the lane and, if necessary, transferring the players to another lane. This event is processed as shown by the next block 192.

With the system waiting to receive the number of the lane concerned, there might also be, as shown by the block 194, an action of cancelling the fault signal in the event of the latter having been given by mistake.

This cancellation signal can be given using the pushbutton switch 23 (which in this case must be pressed and held down for some time), by a respective command from the console 21*b* at the front desk, by a phone call or by a signal generated automatically by the pin setting up machine, as shown, respectively, by the blocks 196, 198, 199 and 201 within the block 194. The cancellation signal then enters the block 144 to check whether the lane concerned is active or not.

The cancellation signal is processed, as shown by the block 203, and the system resumes operation as if no error has occurred.

The management program also comprises means or instructions by which the statistical data relating to the service call on the apparatus are stored and processed in such a way that they can be displayed, for example in a table 300 on the screen 21*d* and printed. The table, or other similar data display method, has one or more areas for describing the following fields: date of the event, in column 302; lane number, in column 304; type of game, in column 306; source of event or fault, in column 308; start of service operations, in column 310; time of mechanic's arrival, in column 312; time taken by mechanic to respond, in column 314; time at which work was completed, in column 316, total down time, in column 318; total work time, in column 320; name of mechanic, in column 322, and comments, if any, in column 324.

Any other information connected with the type of fault might also be stored and displayed in the table. For example, this information might be displayed in the "comments" column 324 or in a specific separate column. The comments column might also contain short notes relating to maintenance to be carried out on the machine. Such maintenance notes might, for example, include the next due date for maintenance or checks to be carried out and the type of work to be done.

The program might also include means or instructions by which the data are processed by the server of the system according to the invention to generate a second table 301, or similar display method, containing a summary of the games played, in area or row 326, the total number of stops, in area or row 328 and the number of games per stop, in area or row 330.

Provision in the program is also made for means or instructions whereby the data are processed in the server 21*a* or, if necessary, in another processing unit of the system, the results displayed in a third table 303, or similar display method, including a row or area 332 showing the average response time of the mechanic, and a row or area 334 showing the average time worked by the mechanic.

According to another advantageous aspect, the system according to the invention might also implement an advantageous procedure whereby the machine operator can communicate directly with the players at the lane.

For this purpose, it is specified that each lane console is equipped with customary, prior art means for emitting and transmitting a voice signal from the bowling centre's FRONT DESK 20.

These prior art sound emission and transmission means consist of a type of intercom system 58 comprising a microphone and a respective loudspeaker located at the console 15 at the lanes.

What prior art did not envisage, however, was the provision of specific means for direct communication between the mechanic, or bowling centre staff, and the players.

According to this further advantageous aspect, the invention therefore contemplates the provision of specific means 60 (shown by the dashed lines in FIG. 2) for the exchange of signals representing a voice signal to be emitted by the sound emission means of the intercom system 58 or to be transmitted, once received, by the means that activate the intercom system 58 itself, at the lane console 15 or similar location.

These signal receiving means, which are connected to the respective microphone or loudspeaker by suitable means comprising, for example, a connection 61, can be any of a range of receiving and transmission means which are well known to experts in the trade and which, for brevity, will not be described in further detail.

According to a first preferred embodiment, the receiving and transmission means 60 are connected to the central control unit 24 through respective connections 2460, shown by the dashed lines in FIG. 2.

In a second preferred embodiment, it is envisaged that the receiving and transmission means 60 communicate, through connections 2160 (shown by the dot-dashed lines in FIG. 2) with lane control units 21' and, through these, with the central unit 24.

Advantageously, therefore, the mechanic is able to communicate directly with the players on the lane through the portable telephone 34 or the fixed telephone 36 (or other suitable means).

It is thus possible to promptly provide the players with direct information regarding, for example, how long the repairs will take or whether it will be possible to carry out the repairs within a reasonable interval of time. In the latter case, the players can therefore promptly decide to move to another free lane or to go to the cashier's desk to pay for the games played so far. The risk of unnecessarily waiting for repairs to be carried out is thus significantly reduced.

In a preferred but non-restrictive manner, the computer program with the means or instructions for implementing the event management procedures described above resides principally in the central unit 21*a*. Secondary parts of the program or auxiliary programs forming part of the main program reside in the main control unit 24.

Secondary parts of the program or auxiliary programs forming part of the main program also reside in the local control unit 26 and, if necessary, in the lane control units 21'.

Whatever the case, the program may be installed in the various operating units in any suitable manner. The management program or a part of it, is stored in a respective computer medium or memory module forming part of the processing units used, that is to say, on suitable discs or other storage devices prior to installation in the hardware components of the system according to the invention.

It should be understood, however, that the various electronic control units used comprise input and output units, memory devices, and suitable processing means or CPUs. All these electronic components may be of any suitable type well within the knowledge of an expert in the trade, and do not therefore necessitate a detailed description herein.

The method and system according to the invention therefore provide very useful information regarding the efficiency of the staff employed and the reliability of the pin setting up machines used in the bowling centre.

Furthermore, statistical data are made readily available on a regular basis, which means that precise schedules for maintenance and checking of bowling establishment equipment can be prepared.

It will be understood that the invention can be adapted and modified in several ways without thereby departing from the scope of the inventive concept. Moreover, all of the details of the invention may be substituted by technically equivalent elements.

What is claimed is:

1. A method for managing at least one event in a bowling establishment or similar facility, the bowling establishment comprising at least one lane along which a ball is rolled and an apparatus for setting up the pins and returning the ball, the method comprising:

generating a signal relating to the at least one event, wherein the at least one event produces a call for service condition;

automatically transmitting the event signal as a notification signal to an operator;

displaying a first image informing players that a fault has been detected;

displaying a second image informing the players that repairs are in progress; and displaying a third image informing the players that the repairs have been completed.

2. A system for managing at least one event in a bowling establishment or similar facility, and in for implementing the method according to any one of the foregoing claims, the bowling establishment comprising at least one lane along which a ball is rolled and an apparatus for setting up the pins and returning the ball, the system comprising:

means for generating a signal relating to the event, wherein the signal generating means are located at the apparatus for setting up the pins and returning the ball; and a control unit that causes first, second, and third images to be displayed on a screen at a bowler bay, wherein:

the first image includes a first portion informing players that a fault has been detected;

second image includes a second portion informing the players that repairs are in progress; and the third image includes a third portion informing the players that the repairs have been completed.

3. A method for managing at least one event in a bowling establishment or similar facility, the bowling establishment comprising at least one lane along which a ball is rolled and a pin setting up machine for setting up pins and returning the ball, the method comprising:

generating an event signal relating to the event, wherein the at least one event produces a call for service condition;

informing bowlers that an error or fault has been detected;

informing bowlers that repair work is in progress; and informing bowlers that the repair work is complete.

4. The method according to claim 3, wherein the at least one event comprises a fault or error.

5. The method according to claim 4, wherein the fault or error comprises a fault in the pin setting up machine.

6. The method according to claim 4, wherein the fault or error comprises a fault that has occurred on the at least one lane.

7. The method according to claim 3, wherein the event signal is a notification signal transmitted automatically.

8. The method according to claim 3, wherein the at least one event comprises cancellation of an error or fault.

9. The method according to claim 8, wherein a cancellation event signal is generated after a fault indication event signal.

10. The method according to claim 3, wherein the event signal is a signal acknowledging receipt of the call or notification.

11. The method according to claim 10, wherein the signal acknowledging receipt is emitted following an operation performed by a maintenance operator.

12. The method according to claim 3, wherein the event signal comprises a signal indicating that work to remedy an error or fault has begun.

13. The method according to claim 12, wherein the signal indicating that work has begun is generated after a fault indication event signal.

14. The method according to claim 12, wherein the signal indicating that work has begun is generated after a fault indication event signal, and when an operator reaches an area where the fault has occurred and begins working on a solution to the fault.

15. The method according to claim 3, wherein the event signal comprises a signal indicating that work to remedy an error or fault has been completed.

16. The method according to claim 15, wherein the signal indicating that work has been completed is generated after commencement of a work event.

17. The method according to claim 15, wherein the signal indicating that work has been completed is generated when an operator has terminated a procedure to solve the error or fault.

18. The method according to claim 3, wherein the at least one event comprises the closure of the lane where a fault has been detected.

19. The method according to claim 3, wherein the event signal is arranged to identify a source that generated the event signal.

20. The method according to claim 3, wherein the event signal is arranged to identify a type of event detected.

21. The method according to claim 3, further comprising identifying an area where a fault has occurred.

22. The method according to claim 21, wherein the identifying an area where a fault has occurred comprises identifying a part of the pin setting up machine where the fault has occurred.

23. The method according to claim 22, wherein the event signal indicates when the part of the pin setting up machine requiring service is a front of the pin setting up machine.

24. The method according to claim 22, wherein the event signal indicates when the part of the pin setting up machine requiring service is a back of the pin setting up machine.

25. The method according to claim 3, wherein the event signal is generated by a manual operation.

26. The method according to claim 3, further comprising automatically generating the event signal.

27. The method according to claim 3, further comprising generating a signal for encoding a signal or an action in response to the event signal.

28. The method according to claim 27, wherein the response signal constitutes at least one piece of information relating to the at least one event.

29. The method according to claim 3, further comprising emitting a signal relating to the at least one event.

30. The method according to claim 29, wherein the emitting a signal is performed by a light emitting device located at the bowling lane.

31. The method according to claim 29, wherein the emitting a signal comprises emitting a sound signal.

32. The method according to claim 29, wherein the emitting a signal comprises emitting a video signal.

33. The method according to claim 32, wherein the video signal is emitted on a screen located at the lane.

34. The method according to claim 29, wherein the emitting a signal comprises emitting a telephone signal.

35. The method according to claim 29, wherein a response signal defines a notification.

36. The method according to claim 35, wherein a notification signal comprises at least one piece of information relating to the at least one event.

37. The method according to claim 36, wherein the information relating to the at least one event defines a notification of a fault.

38. The method according to claim 37, wherein the fault notification defines a type of fault.

39. The method according to claim 37, wherein the fault notification defines an area where the fault has occurred.

40. The method according to claim 37, wherein the fault notification defines a part of the pin setting up machine that requires service.

41. The method according to claim 40, wherein the fault notification defines whether the part requiring service is accessible from a front or from a back of the pin setting up machine.

42. The method according to claim 36, wherein the notification signal comprises information that an operator has been called.

43. The method according to claim 36, wherein the notification signal comprises information that repair work has commenced.

44. The method according to claim 36, wherein the notification signal comprises information that repair work has been completed.

45. The method according to claim 36, wherein the notification signal comprises information that the lane is closed.

46. The method according to claim 3, further comprising counting time taken by an operator to perform an operation.

47. The method according to claim 3, wherein the informing bowlers that an error or fault has been detected comprises displaying an image providing information that the error or fault has been detected.

48. The method according to claim 3, further comprising displaying an image providing information that a mechanic has been notified.

49. The method according to claim 3, further comprising displaying an image providing information that a mechanic has arrived.

50. The method according to claim 3, wherein the informing bowlers that repair work is in progress comprises displaying an image providing information that repair work is in progress.

51. The method according to claim 3, further comprising generating a repair work completed signal by a mechanic pressing a pushbutton switch on the pin setting up machine.

52. The method according to claim 3, further comprising providing a repair work completed signal by telephone.

53. The method according to claim 3, further comprising providing a repair work completed signal through a main console.

54. The method according to claim 3, further comprising the pin setting up machine automatically generating a repair work completed signal.

55. The method according to claim 3, further comprising displaying an image providing information that repair work has been completed successfully.

56. The method according to claim 44, wherein the repair work completed signal is processed by a routine that checks whether the lane concerned is open or closed.

57. The method according to claim 4, wherein the event signal comprises an error or fault signal and is generated by a pushbutton switch located at a bowlers' bay.

58. The method according to claim 4, wherein a fault event signal is first tested to check whether the lane is actually open.

59. The method according to claim 57, further comprising testing to check whether the pushbutton switch is enabled.

60. A system for managing at least one event in a bowling establishment, the bowling establishment comprising at least one lane along which a ball is rolled and a pin setting up machine for setting up the pins and returning the ball, comprising:

a signal generating device that generates an event signal relating to the at least one event; and a control system structured and arranged to:

inform bowlers that an error or fault has been detected;

inform bowlers that repair work is in progress; and inform bowlers that the repair work is complete.

61. The system according to claim 60, wherein the bowling establishment comprises a bowlers' bay.

62. The system according to claim 60, wherein the bowlers' bay is equipped with display means.

63. The system according to claim 60, wherein the signal generating device can be activated manually.

64. The system according to claim 63, wherein the signal generating device comprises a control console.

65. The system according to claim 63, wherein the signal generating device comprises a console, which is located at a front desk of the bowling establishment.

66. The system according to claim 63, wherein the signal generating device comprises a console, which is located at a bowlers' bay.

67. The system according to claim 60, wherein the signal generating device generates the event signal automatically upon occurrence of the at least one event.

68. The system according to claim 67, wherein the signal generating device comprises a controller for controlling the pin setting up machine.

69. The system according to claim 60, wherein the signal generating device is activated by a switch.

70. The system according to claim 60, wherein the signal generating device is located at a bowlers' bay.

71. The system according to claim 60, wherein the signal generating device comprise a phone set.

72. The system according to claim 71, wherein the phone set comprises a portable telephone.

73. The system according to claim 71, wherein the phone set comprises a fixed telephone.

74. The system according to claim 60, further comprising a controller that generates a response signal for encoding a signal or an action in response to the event signal.

75. The system according to claim 74, wherein the response signal constitutes at least one piece of information relating to the at least one event.

76. The system according to claim 74, wherein the controller comprises a main control unit.

77. The system according to claim 74, wherein the controller comprises a central unit for controlling the at least one event.

78. The system according to claim 77, wherein the central unit communicates with a main unit.

79. The system according to claim 74, wherein the controller comprises a local control unit.

80. The system according to claim 79, wherein the local control unit communicates with a central unit.

81. The system according to claim 79, wherein a switch activated device at the pin setting up machine communicates with the local control unit.

82. The system according to claim 79, wherein a control device at the pin setting up machine communicates with the local control unit.

83. The system according to claim 79, wherein a switch activated device at a bowlers' bay communicates with the local control unit.

84. The system according to claim 60, further comprising a signal emitter for emitting a signal relating to the at least one event.

85. The system according to claim 84, wherein the signal emitter comprises a light emitter located at the lane.

86. The system according to claim 85, wherein the light emitter is connected to a local control unit.

87. The system according to claim 84, wherein the signal is emitted as a sound signal.

88. The system according to claim 84, wherein the signal is emitted as a video signal.

89. The system according to claim 88, wherein the signal is emitted by a screen at the lane.

90. The system according to claim 84, wherein the signal is emitted as a telephone signal.

91. The system according to claim 90, wherein the signal emitter comprises a portable telephone.

92. The system according to claim 91, wherein the portable telephone communicates with a central unit.

93. The system according to claim 84, wherein the signal emitter comprises a telephone connected by cable to a central unit.

94. The system according to claim 60, wherein the pin setting up machine automatically generates a repair work successfully completed signal.

95. A computer program stored in a computer readable medium or memory module, comprising means or instructions that implement the steps of claim 3.

96. A computer program stored in a computer readable medium or memory module, comprising means or instructions that implement the steps of claim 1.

97. The method of claim 1, wherein the notification signal comprises a predetermined message that is automatically transmitted upon occurrence of the at least one event.

* * * * *